US007494205B2

(12) United States Patent
Kusunoki et al.

(10) Patent No.: US 7,494,205 B2
(45) **Date of Patent: *Feb. 24, 2009**

(54) MAINTENANCE/RECOVERY DEVICE FOR LIQUID DISCHARGE DEVICE AND IMAGE FORMING DEVICE

(75) Inventors: Masanori Kusunoki, Kanagawa (JP); Toshitaka Osanai, Kanagawa (JP); Noboru Hiramatsu, Aichi (JP); Michio Yamamoto, Aichi (JP)

(73) Assignee: Ricoh Company, Ltd, Tokyo (JP)

( * ) Notice: Subject to any disclaimer, the term of this patent is extended or adjusted under 35 U.S.C. 154(b) by 98 days.

This patent is subject to a terminal disclaimer.

(21) Appl. No.: 10/566,864

(22) PCT Filed: Jun. 28, 2005

(86) PCT No.: PCT/JP2005/012273

§ 371 (c)(1),
(2), (4) Date: Jan. 31, 2006

(87) PCT Pub. No.: WO2006/001535

PCT Pub. Date: Jan. 5, 2006

(65) Prior Publication Data

US 2006/0290738 A1 Dec. 28, 2006

(30) Foreign Application Priority Data

Jun. 29, 2004 (JP) ..... 2004-190618

(51) Int. Cl.
*B41J 2/165* (2006.01)
*B41J 2/135* (2006.01)

(52) U.S. Cl. ..... 347/29; 347/30; 347/32; 347/45

(58) Field of Classification Search ..... 347/29, 347/30, 45, 100, 32
See application file for complete search history.

(56) References Cited

U.S. PATENT DOCUMENTS 5,717,444 A 2/1998 Sugimoto et al.

(Continued)

FOREIGN PATENT DOCUMENTS

EP 1083052 A2 3/2001

(Continued)

OTHER PUBLICATIONS

Mar. 26, 2007 Japanese official action in connection with Japanese patent application JP2004-190618.

(Continued)

*Primary Examiner*—Shih-Wen Hsieh
(74) *Attorney, Agent, or Firm*—Cooper & Dunham, LLP

(57) ABSTRACT

In a maintenance/recovery device for a liquid discharging device, a cap member covers a surface of a nozzle of a liquid discharging head, the liquid discharging head discharging a droplet of a recording liquid from the nozzle. A resilient contact member is provided in the cap member to come in contact with the surface of the nozzle. A recess-forming member is providing in the cap member to form a recess for receiving the recording liquid attracted from the nozzle. The contact member and the recess-forming member are integrally formed by molding, the recess-forming member is made of a resin material containing a water repellent agent, and the recess-forming member is provided to have at least two slopes being inclined toward an outlet at a bottom of the recess.

10 Claims, 5 Drawing Sheets

U.S. PATENT DOCUMENTS

| | | | | |
|---|---|---|---|---|
| 6,481,826 | B1 * | 11/2002 | Hara et al. | 347/29 |
| 6,695,443 | B2 * | 2/2004 | Arita et al. | 347/100 |
| 6,729,716 | B2 | 5/2004 | Eguchi et al. | |
| 2002/0075348 | A1 | 6/2002 | Shindo et al. | |
| 2003/0107632 | A1 | 6/2003 | Arita et al. | |
| 2003/0234829 | A1 | 12/2003 | Takahashi | |

FOREIGN PATENT DOCUMENTS

| | | |
|---|---|---|
| JP | 6-238915 | 8/1994 |
| JP | 2000-025777 | 1/2000 |
| JP | 3106783 | 9/2000 |
| JP | 2001-71514 | 3/2001 |
| JP | 2001-349062 | 12/2001 |
| JP | 2002-102087 | 4/2002 |
| JP | 2003-1839 | 1/2003 |
| JP | 2003-96355 | 4/2003 |
| JP | 2003-276213 | 9/2003 |

OTHER PUBLICATIONS

Jun. 30, 2008 European search report in connection with corresponding European application No. 05 75 5235.

* cited by examiner

MAINTENANCE/RECOVERY DEVICE FOR LIQUID DISCHARGE DEVICE AND IMAGE FORMING DEVICE

TECHNICAL FIELD

The present invention relates to a maintenance/recovery device for a liquid discharge device, and relates to an image forming device having the liquid discharge device provided with the maintenance/recovery device.

BACKGROUND ART

Among various image forming devices, such as printers, facsimiles, copiers, multi-function peripherals, and plotters, there is an image forming device which has a liquid discharge device in which a liquid discharging head for discharging a droplet of a recording liquid is provided as a recording head.

For this image forming device, a maintenance/recovery device which is provided to maintain and recover the performance of the recording head which discharges the recording liquid is indispensable. Generally, this maintenance/recovery device comprises a moisture-retaining cap, a suction cap member, a wiper blade, and an idle discharge receptacle.

The moisture-retaining cap member is provided to cover the nozzle surface with high sealing nature being maintained, in order to prevent fixing of the recording liquid near the nozzle due to natural evaporation of the recording liquid as the ink. The suction cap member is provided for attracting and discharging the recording liquid with high viscosity from the nozzle. The suction cap member may be used to concurrently serve as the moisture-retaining cap member. The wiper blade is provided for wiping off and removing the recording liquid adhering to the nozzle surface. The idle discharge receptacle is used when performing idle discharging in which a droplet of the recording liquid which does not contribute to the image formation is discharged.

Generally, the cap member provided for use in the maintenance/recovery device includes a contact member which is made of an elastic member and contacts the nozzle surface of the recording head, and a recess-forming member in which the recess for receiving the recording liquid attracted from the nozzle on the nozzle surface is formed.

Japanese Patent No. 3106783 discloses a cap member for a conventional ink-jet printing device. This cap member includes the first slope that is loosely inclined toward the ink outlet, and the second slope that extends from the first slope and is steeply inclined toward the ink outlet, so that the remaining ink near the ink outlet may be reduced.

Japanese Laid-Open Patent Application No. 2001-071514 discloses a cap member for a conventional ink-jet printing device in which the tapered space part which is continuously reduced toward the ink outlet is formed, and the ink holding means is disposed in the pipe passage connecting the ink suction port to the negative pressure generating means. The ink in the tapered space part is discharged, and the moisture inside the cap member is retained with the ink in the pipe passage.

Japanese Laid-Open Patent Application No. 6-238915 discloses a cap member for a conventional ink-jet printing device in which the water repellent agent is applied to the inside surface of the cap member for increased water repellence. This cap member is directed to facilitating the ink suction of the cap member by reducing the ink adhering to the cap inside surface.

Japanese Laid-Open Patent Application No. 2003-001839 discloses a cap member for a conventional ink-jet printing device, the cap member being comprised of the elastic sealing member covering the nozzle surface, and the rigid member forming the sealed space part. This cap member is directed to raising the air-tightness. Either or both of the elastic sealing member and the rigid member are formed from a water repellent material with the contact angle to the ink being 90 degrees or more.

For the purposes of obtaining good coloring nature and high reliability, the dye ink is initially used as the coloring agent of the ink in the ink-jet recording device as the image forming device. In recent years, however, in order to give light resistance and water resistance to a recorded image, there is the major trend in which the pigment ink which containing a pigment, such as carbon black, is used increasingly.

Moreover, there is also the trend in which the viscosity of the ink is raised for the purposes of making the flexibility of ink prescription high and preventing the blotting of an image on a plain paper after the discharged ink reaches the plain paper.

In the case of the above-mentioned pigment ink with high viscosity, the ink viscosity greatly changes with temperature. Although some difference arises according to the ink prescription, the ink which has a viscosity of 8 cp at 22 degrees C. may have a viscosity exceeding 15 cp at 10 degrees c, and may have a viscosity of about 5 cp at 32 degrees c.

According to the experiments of the inventors of the present invention, when such high-viscosity ink is attracted to the conventional cap member, it is difficult to stably discharge the ink with the conventional cap member used.

In the case of the cap member of Japanese Patent No. 3106783, the remaining ink near the ink outlet may be reduced. However, when the pigment ink, especially the pigment ink with a high viscosity of 5 cp or more, is used, there is the problem in that the discharging of the ink becomes inadequate.

Also, in the case of the cap member of Japanese Laid-Open Patent Application No. 2001-071514, there is the problem in that the discharging of the ink becomes inadequate when the pigment ink, especially the pigment ink with a high viscosity of 5 cp or more, is used.

In the case of the cap member of Japanese Laid-Open Patent Application No. 6-238915, the suction of the ink is facilitated by increasing the water repellence of the cap inside. However, when the pigment ink with a viscosity of 5 cp or more and a surface tension of 40 mN/m or less at 25 degrees C. is used, the ink wettability is extremely high even if the water-repellent finish is given. For this reason, it is confirmed that the discharging of the ink is not enough.

Moreover, when the contact member which contacts the nozzle surface, and the recess-forming member in which this contact member is provided are integrally formed by molding, it is difficult to apply the water repellent agent uniformly to the recess inside the recess-forming member in which the contact member is provided.

Furthermore, in the case of the cap member of Japanese Laid-Open Patent Application No. 2003-001839, it is confirmed that, when the pigment ink with the viscosity of 5 cp or more and the surface tension of 40 itiN/m or less at 25 degrees C. is used, it is difficult to form either or both of the elastic sealing member and the rigid member from a water repellent material with the contact angle to the ink being 90 degrees or more.

SUMMARY

Another object of the present invention is to provide In an aspect of this disclosure, a maintenance/recovery device for a liquid discharging device is provided in which the water repellence of a cap member is increased with simple composition and the discharging characteristic of the recording liquid with high viscosity is increased.

In an exemplary embodiment of this disclosure, a maintenance/recovery device for a liquid discharge device includes a cap member covering a surface of a nozzle of a liquid discharging head, the liquid discharging head discharging a droplet of a recording liquid from the nozzle, a resilient contact member provided in the cap member to come in contact with the surface of the nozzle, a recess-forming member providing in the cap member to form a recess for receiving the recording liquid attracted from the nozzle, wherein the contact member and the recess-forming member are integrally formed by molding, the recess-forming member is made of a resin material containing a water repellent agent, and the recess-forming member is provided to have at least two slopes being inclined toward an outlet at a bottom of the recess.

It is preferred that the above-mentioned maintenance/recovery device is configured so that a content of the water repellent agent in the resin material which forms the recess-forming member does not exceed 10 weight percent.

It is preferred that the above-mentioned maintenance/recovery device is configured so that the recess of the recess-forming member is provided with corners which are curved.

It is preferred that the above-mentioned maintenance/recovery device is configured so that a sum of an inclination angle of the slopes of the recess-forming member to a horizontal surface and a contact angle between the slopes and the recording liquid is 70 degrees or more. In this case, it is preferred that the sum of the inclination angle and the contact angle is 90 degrees or more.

In order to achieve the above-mentioned objects, the present invention provides In another exemplary embodiment of this disclosure, an image forming device is provided comprising a liquid discharge head provided as a recording head which discharges a droplet of a recording liquid from a nozzle; and a maintenance/recovery device provided to maintain and recover performance of the liquid discharge head, the maintenance/recovery device comprising: a cap member covering a surface of the nozzle of the liquid discharging head; a resilient contact member provided in the cap member to come in contact with the surface of the nozzle; a recess-forming member providing in the cap member to form a recess for receiving the recording liquid attracted from the nozzle, wherein the contact member and the recess-forming member are integrally formed by molding, the recess-forming member is made of a resin material containing a water repellent agent, and the recess-forming member is provided to have at least two slopes being inclined toward an outlet at a bottom of the recess.

It is preferred that the above-mentioned image forming device is configured so that the recording liquid contains a water, a pigment of 6 weight percent or more, a polymer component, and a water-soluble organic solvent, and the recording liquid has a surface tension of 40 mN/m or less at 25 degrees C. and has a viscosity that is above 5 cp and below 20 cp at 25 degrees C.

According to the maintenance/recovery device of the present invention, the contact member and the recess-forming member are integrally formed by molding, the recess-forming member is made of a resin material containing a water repellent agent, and the recess-forming member is provided to have at least two slopes being inclined toward an outlet at a bottom of the recess. For this reason, it is possible to increase the water repellence of the cap member with simple composition. The recording liquid attracted into the cap member is transmitted to the slopes of the recess and easily led to the ink outlet. Even when the recording liquid with a viscosity of 5 cp or more and a surface tension of 40 mN/m or less is used in the liquid discharge device, it is possible to increase the discharging characteristic of the recording liquid with high viscosity.

Since the image forming device of the present invention comprises the liquid discharge head provided with the above-mentioned maintenance/recovery device, it is possible to form an image with high quality even when the recording liquid with a viscosity of 5 cp or more and a surface tension of 40 mN/m or less is used in the liquid discharge head.

Other aspects, features and advantages of the present invention will be apparent from the following detailed description when reading in conjunction with the accompanying drawings.

BEST MODE FOR CARRYING OUT THE INVENTION

A description will now be given of the preferred embodiments of the invention with reference to the accompanying drawings.

Figure 1:
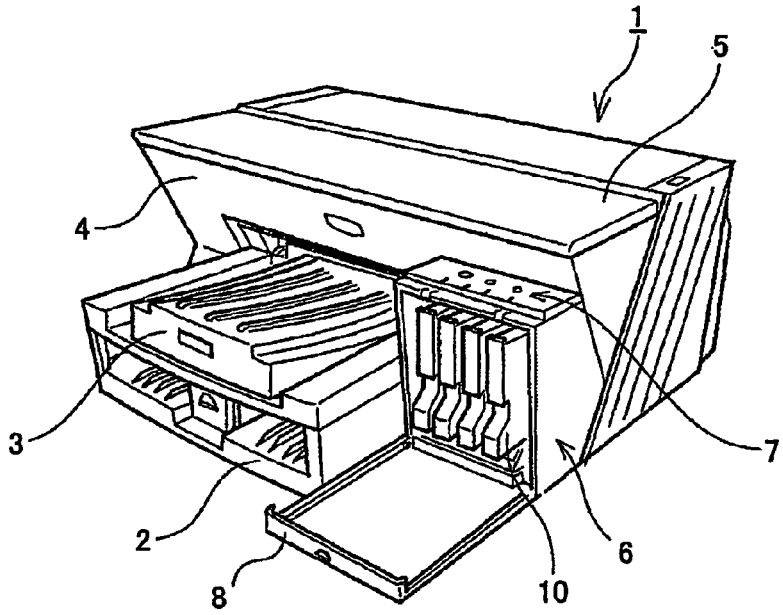
FIG. 1 is a perspective diagram showing the composition of an image forming device to which an embodiment of the maintenance/recovery device for the liquid discharge device according to the invention is applied.

FIG. 1 shows the composition of an image forming device to which an embodiment of the maintenance/recovery device for the liquid discharge device according to the invention is applied. FIG. 1 is a perspective view of the image forming device which is seen from the front side of the image forming device.

As shown in FIG. 1, the image forming device comprises the main body 1, the sheet feeding tray 2 which is attached to the main body 1 for supplying the recording sheet, and the paper output tray 3 which is attached to the main body 1 for stocking the recording sheet on which an image is printed (image formation).

The image forming device further comprises the cartridge loading portion 6 at one end of the front face 4 of the main body 1, the cartridge loading portion 6 being projected from the front face 4 and formed lower than the upper surface 5. The image forming device has the operation panel 7, including operation keys, a display and indicators, which is disposed on the upper surface of the cartridge loading portion 6.

The cartridge loading portion 6 contains the main tanks (ink cartridges) 10 which are the liquid storing tanks as a liquid replenishing means, and the main tanks 10 are exchangeable. The cartridge loading portion 6 is equipped with the front cover 8 which can be opened and closed.

Figure 2:
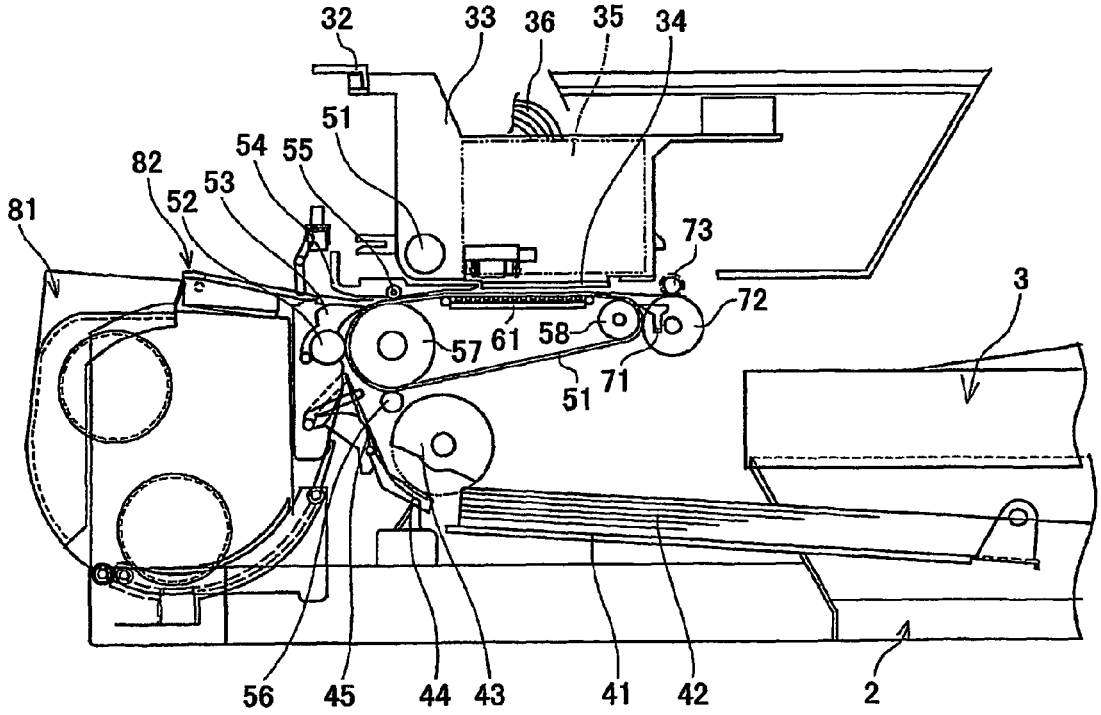
FIG. 2 is a cross-sectional view showing the composition of the mechanism part in the image forming device of FIG. 1.
Figure 3:
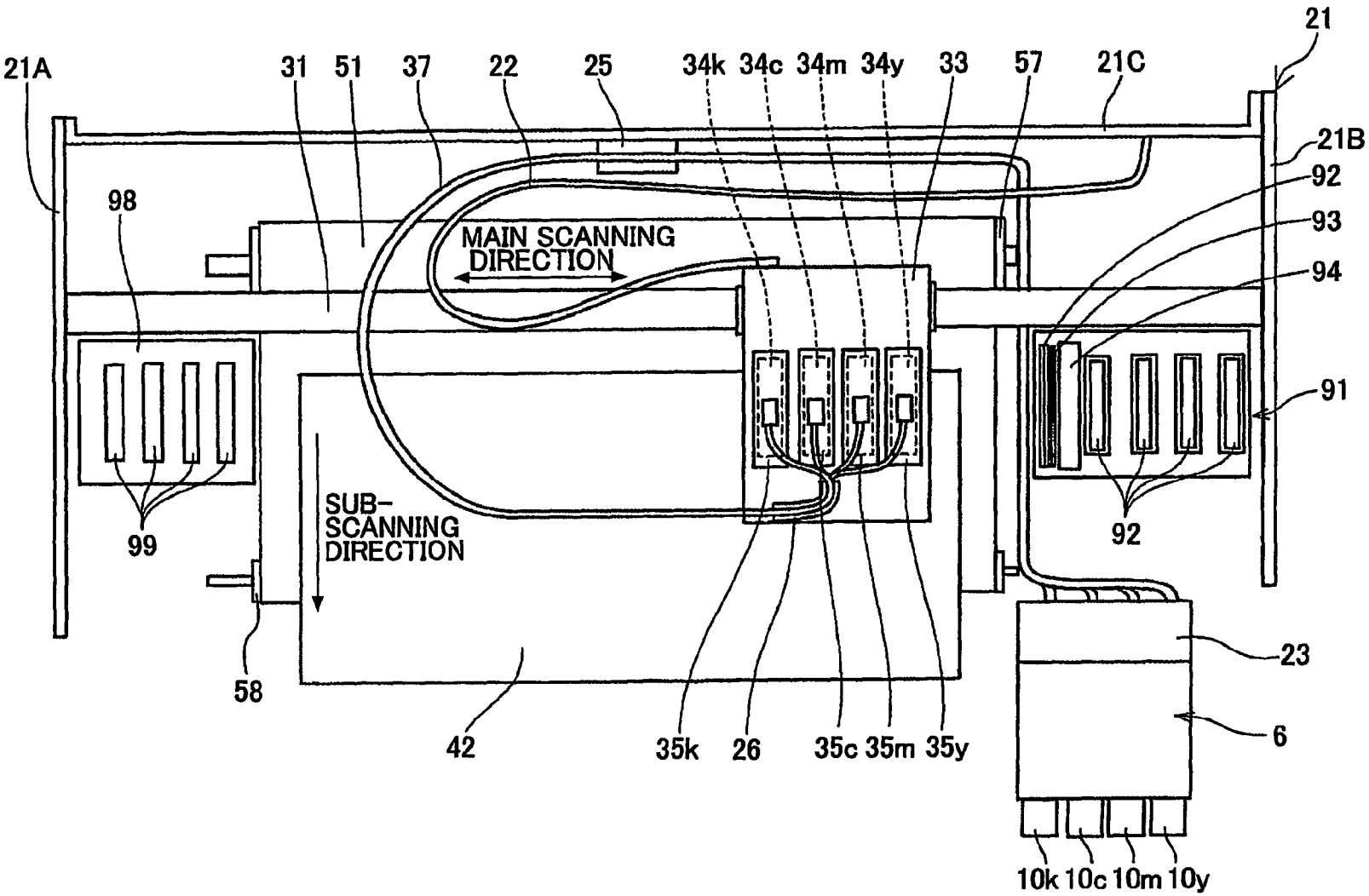
FIG. 3 is a plan view showing the composition of the mechanism part of FIG. 2.

Next, the mechanism part of the image forming device of the present embodiment will be explained with reference to FIG. 2 and FIG. 3. FIG. 2 shows the composition of the mechanism part, and FIG. 3 shows the principal part of the mechanism part.

The right and left side plates 21A and 21B form the frame 21. The guide rod 31 and the stay 32 are the guide members which are arranged across the side plates 21A and 21B so that the carriage 33 is held slidably in the main scanning direction. The carriage 33 is moved in the direction (the main scanning direction) indicated by the arrow in FIG. 3 by the main-scanning motor (not illustrated).

The carriage 33 is equipped with the plurality of recording heads 34 which are the plurality of ink jet heads for discharging the droplet (ink drop) of the recording liquid, and arranged along the line parallel to the main scanning direction. The plurality of nozzles of the recording heads 34 are disposed in the direction intersecting the main scanning direction, and the ink drop discharging direction is directed downward.

The recording heads 34 include the recording head 34*y* which discharges a droplet of yellow (y) ink, the recording head 34 which discharges a droplet of magenta (M) ink, the recording head 34*c* which discharges a droplet of cyan (c) ink, and the recording head 34*b* which discharges a droplet of black (Bk) ink. When the recording head 34 is referred to, the ink color of the recording head is disregarded.

The composition of the recording heads is not restricted to this embodiment. The recording heads may also be constituted by one or the plurality of recording heads each having one or the plurality of nozzles from which the droplet of one or the plurality of color inks is discharged.

The liquid discharging heads which constitute the recording heads 34 may include, as the energy generating means for discharging the droplet of the recording liquid, any of the piezoelectric actuators which use piezoelectric elements, the thermal actuators which use the phase change by liquid film boiling using electro thermal conversion elements, such as exothermic resistors, the electrostatic actuator using the electrostatic force, and the shape memory alloy actuator using the metal phase change by a temperature change.

The carriage 33 carries the sub-tanks 35*y*, 35*m*, 35*c*, and 35*k* of the respective color inks for supplying the recording liquid of each color ink to the corresponding one of the recording heads 34, respectively. When the sub-tank 35 is referred to, the ink color of the sub-tank is disregarded.

The recording liquid from the ink cartridge 10 of each color ink mentioned above is supplied to the sub-tank 35 of each color via the recording liquid supply tube 37. When the ink cartridges 10*y*, 10*m*, 10*c*, and 10*k* are referred to, the respective color inks are distinguished.

As shown in FIG. 3, the ink cartridges 10 are accommodated in the cartridge loading portion 6, and the supply pump unit 23 for sending the recording liquid from the ink cartridges 10 is arranged in the cartridge loading portion 6.

The recording liquid supply tube 37 from the ink cartridge loading portion 6 to the sub-tank 35 is fixed at its intermediate portion to the back plate 21C by the main body side holder 25. The back plate 21C constitutes part of the frame 21. The intermediate portion of the recording liquid supply tube 37 is further fixed by the fixing rib 26 on the carriage 33.

On the other hand, the sheet feeding part for supplying the recording sheet 42 loaded on the sheet stacking part (the base plate) 41 of the sheet feeding tray 2 includes the semicircular feed roller 43 and the separating pad 44 opposing to the feed roller 43. The feed roller 43 and the separating pad 44 serve to separately supply every one sheet of the recording sheets 42 from the sheet stacking part 41. The separating pad 44 is made of the material with a large coefficient of friction, and this separating pad 44 is resiliently pressed on the surface of the feed roller 43.

The transport part for conveying the recording sheet 42 fed from the paper feeding part under the lower part surface of the recording head 34 includes the following elements: the transport belt 51 for conveying the recording sheet 42 through electrostatic adsorption; the counter roller 52 for pressing the recording sheet 42 sent through the guide 45 from the paper feeding part against the transport belt 51; the conveyance guide 53 for changing the transport path of the recording sheet 42 sent in the generally perpendicular upward direction by about 90 degrees so that the recording sheet 42 is placed on the transport belt 51; and the edge pressurizing roller 55 which is energized to the transport belt 51 surface by the holding member 54.

Moreover, the transport part for conveying the recording sheet 42 includes the charging roller 56 which is a charging means for charging the transport belt 51 surface.

The transport belt 51 is an endless belt, and this belt is wound between the conveyance roller 57 and the tension roller 58. The transport belt 51 is constituted so that it may go around in the belt conveyance direction of FIG. 3.

The charging roller 56 contacts the surface of the transport belt 51, and this roller is arranged so that it may be rotated to follow the rotation of the transport belt 51. The pressure which is exerted on the both ends of the charging roller 56 shaft about 2.5 N.

In the back of the transport belt 51, the guide member 61 is arranged at the position corresponding to the printing area where the printing is performed on the recording sheet by the recording head 54. The upper surface has projected this guide member 61 to the recording head 34 surface rather than the tangent of two rollers (conveyance roller 57 and tension roller 58) which support the transport belt 51. Thereby, the transport belt 51 is pushed up and guided in the printing area on the upper surface of guide member 61, highly precise flatness is maintained.

The sheet ejection part for outputting the recording sheet 42 recorded by the recording head 34 includes the following elements: the separation nail 71 for separating the recording sheet 42 from the transport belt 51; the delivery roller 72; the delivery roller 73; and the paper output tray 3 which is provided under the delivery roller 72.

The height from the area between the delivery roller 72 and the delivery roller 73 to the paper output tray 3 is made to some extent high in order to increase the quantity which can be stacked on the paper output tray 3.

The back part of the main body 1 is provided with the double-sided feeding unit 81 detachably. This double-sided feeding unit 81 receives the recording sheet 42 returned by the opposite direction rotation of the transport belt 51, reverses the recording sheet 42, and feeds the reversed recording sheet 42 to the area between the counter roller 52 and the transport belt 51. The manual feed part 82 is formed in the upper surface of the double-sided feeding unit 81.

As shown in FIG. 3, the maintenance/recovery device (the sub-system) 91 of the liquid discharge device of the present invention is arranged in the non-printing area of one side of the scanning direction of carriage 33, so that the state of the nozzle of recording head 34 is maintained and recovered.

The sub-system 91 is provided with the respective cap members 92*a*-92*d* which cover each nozzle surface of the recording heads 34. When the cap 92 is referred to, the ink color of the cap member is disregarded.

The sub-system 91 is provided with wiper blade 93 for carrying out wiping of the nozzle surface. The sub-system 91 is provided with the idle discharge receptacle 94 which receives the droplet when performing idle discharge which carries out discharge of the droplet which does not contribute to record in order to discharge the recording liquid of high viscosity.

The sub-system 91 is provided with the wiper cleaner 95 for removing the recording liquid adhering to wiper blade 93 by which integral molding is carried out to the idle discharge receptacle 94.

The sub-system 91 is provided with the cleaner roller 96 which forces the wiper blade 93 on the wiper cleaner 95 surface at the time of cleaning of the wiper blade 93.

As shown in FIG. 3, the idle discharge receptacle 98 which receives the droplet when performing idle discharge which makes the non-printing area of the other side of the scanning direction of carriage 33 breathe out the droplet which does not contribute to record in order to discharge the recording liquid of high viscosity during record is arranged.

This idle discharge receptacle 98 is provided with the opening 99 along the nozzle line direction of the recording head 34.

In this ink-jet recording device, separation feeding of every one sheet of the recording sheet 42 is carried out from the sheet feeding tray 2. The recording sheet 42 sent to the generally perpendicular upper part is guided by the guide 45 and placed between the transport belt 51 and the counter roller 52, and the sheet is conveyed.

The edge of the recording sheet 42 is guided by the conveyance guide 53, is pushed by the transport belt 51 by the edge pressurizing roller 55, and the path of the recording sheet 42 is changed by about 90 degrees in the conveyance direction.

At this time, alternating voltage is impressed so that a plus output and a minus output may repeat from a high voltage power supply by turns to the charging roller 56 by the control circuit which is not illustrated.

The transport belt 51 is charged in the direction of the sub-scanning which is the circumference direction according to the voltage pattern charged alternately in a belt-like pattern by the width predetermined in plus and minus.

If the recording sheet 42 is transported on the transport belt 51 alternately charged, the transport belt 51 will suck electrostatically the recording sheet 42, and the recording sheet 42 will be conveyed in the direction of sub-scanning by circumference movement of the transport belt 51.

While the carriage 33 is moved, the recording head 34 is driven according to the image signal so that the recording head 34 injects an ink drop to the recording sheet 42 being stopped to record one line thereon. The following line is recorded for the recording sheet 42 after the recording sheet 42 is conveyed by a given amount.

When the recording end signal is received or when the detection signal indicating that the rear end of the recording sheet 42 reaches the record area is received, the recording operation is completed and the recording sheet 42 is ejected to the paper output tray 3.

During the printing (record) standby state, the carriage 33 is moved to the sub-system 91 surface, and capping of the recording head 34 is carried out by the cap member 92. Thus, the poor discharge of the nozzle by ink dryness is prevented by maintaining the nozzle in a wet condition.

In the state in which capping of the recording head 34 is carried out by the cap member 92, the recording liquid is attracted from the nozzle (nozzle suction or head suction) so that the recovery action is performed to discharge the recording liquid of high viscosity with the air bubbles.

The idle discharging operation which discharges a droplet of the ink that is not related to printing is performed during the printing operation or before the start of the printing operation. For this reason, the stable discharge performance of the recording head 34 is maintained.

Figure 5:
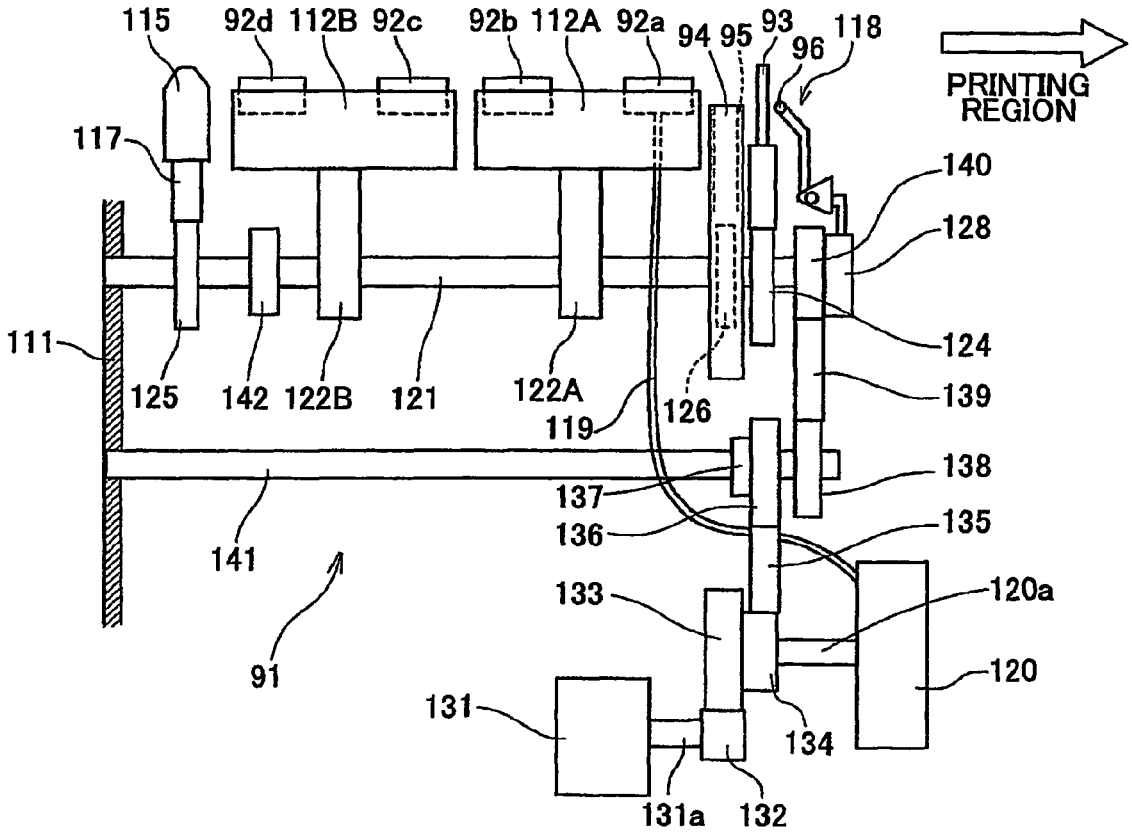
FIG. 5 is a diagram for explaining the outline composition of the sub-system of FIG. 4.
Figure 6:
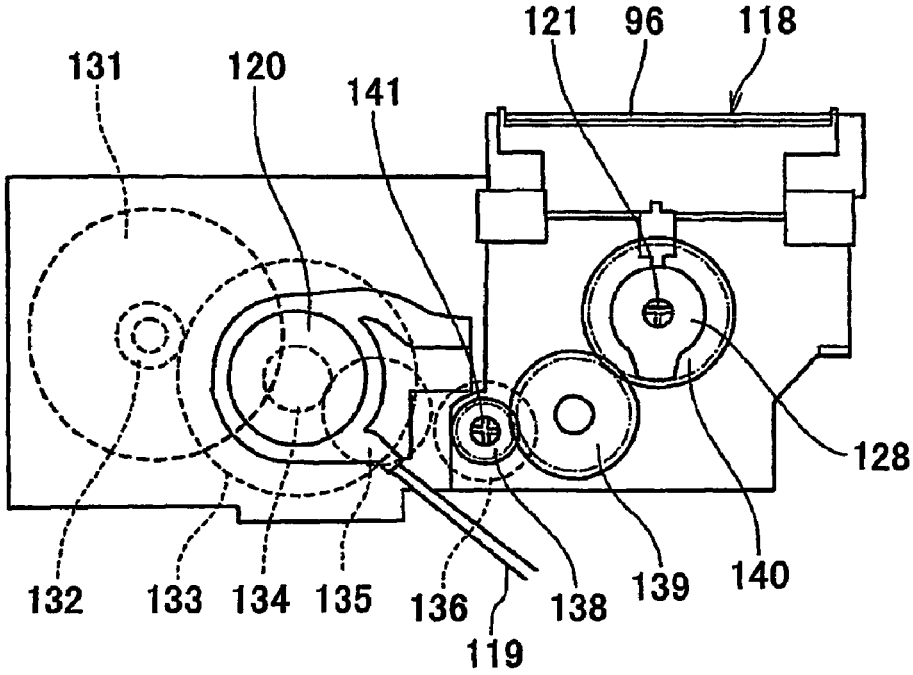
FIG. 6 is a diagram showing the right-hand side surface of the sub-system of FIG. 4.

Next, the composition of the sub-system 91 contained in the maintenance/recovery device of the invention in the image forming device will be explained with reference to FIG. 4 through FIG. 6.

Figure 4:
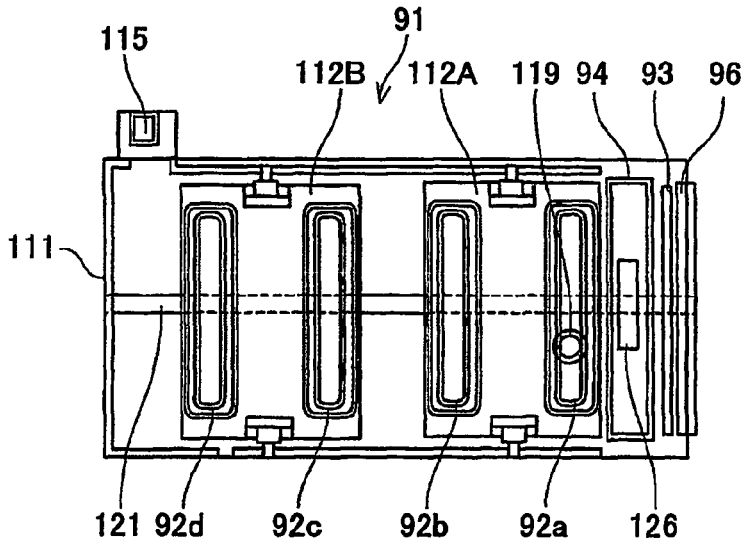
FIG. 4 is a plan view showing the composition of a sub-system containing the maintenance/recovery device of the invention.

FIG. 4 shows the principal part of the sub-system 91. FIG. 5 shows the outline composition of the sub-system 91. FIG. 6 shows the right-hand side elevation of the sub-system 91 of FIG. 4.

The cap holders 112A and 112B, the wiper blade 93 containing the elastic body, and the carriage lock 115 are held respectively in the frame 111 of the sub-system 91, so that these components can be moved up and down.

The idle discharge receptacle 94 is arranged between the wiper blade 93 and the cap holder 112A. In order to clean the wiper blade 93, the wiper cleaner 118 containing the cleaner roller 96 for forcing the wiper blade 93 on the wiper cleaner 95 for the idle discharge receptacle 94 to clean the surface from the outside of the frame 111 is held rockable.

The caps 92*a* and 92*b* and the caps 92*c* and 92*d* which carry out capping of the nozzle surfaces of two recording heads 34 respectively are held at the cap holders 112A and 112B, respectively. When distinguishing the two cap holders 112A and 112B is not needed, they will be referred to as the cap holder 112.

The pump (suction pump) 120 is connected via the flexible tube 119 to the cap 92*a* which is held on the cap holder 112A which is located nearest to the printing area. The pump 120 is not connected to the other caps 92*b*, 92*c*, and 92*d*. Namely, only the cap 92*a* serves as the suction/moisture-retaining cap, and the other caps 92*b*, 92*c*, and 92*d* serve as the moisture-retaining caps.

When performing the recovery action of the recording head 34, the recording head 34 which is subjected to the recovery action is selectively moved to the position where the capping can be performed with the suction cap 92*a*.

In the lower part of the cap holders 112A and 112B, the cam shaft 121 which is rotatably supported on the frame 111 is arranged. The cam shaft 121 is provided with the following: the cap cams 122A and 122B for making it go up and down the cap holders 112A and 112B; the wiper cam 124 for making it go up and down wiper blade 93; the carriage lock cam 125 for making it go up and down carriage lock 115 via carriage lock arm 117; the cleaner cam 128 for making roller 126 and wiper cleaner 118 as body of revolution which requires the droplet by which idle discharge is carried out within idle discharge receptacle 94 rock; the cap 92 is made to go up and down by the cap cams 122A and 122B.

The wiper blade 93 is made to go up and down by wiper cam 124. The wiper cleaner 118 marches out at the time of descent, and the ink adhering to the wiper blade 93 fails to be scratched in the idle discharge receptacle 94 by descending being inserted into the cleaner roller 96 of the wiper cleaner 118, and the wiper cleaner 95 of the idle discharge receptacle 94.

Energization of the carriage lock 115 is carried out to the upper part (lock direction) with the compression spring which is not illustrated. The carriage lock 115 goes up and down via carriage lock arm 117 driven by the carriage lock cam 125.

Since the pump 120 and the cam shaft 121 are rotated, the pump gear 133 provided in the pump shaft 120*a* of the pump 120 is engaged on the motor gear 132 which provided rotation of the motor 131 in the motor shaft 131*a*.

On the pump gear 133 and the middle gear 134 of one, the middle gear 136 with the free wheeling clutch 137 is engaged via the middle gear 135. The cam gear 140 fixed to the middle gear 136 and the middle gear 138 of the same axle via the middle gear 139 at the cam shaft 121 is engaged. The intermediate shaft 141 is the axis of rotation of the middle gears 136 and 138 with the clutch 137.

The intermediate shaft 141 is held pivotally by the frame 111. The cam 142 for the home-position sensor for detecting the home position is formed in the cam shaft 121. When the cap 92 comes to the lowest edge by the home-position sensor (not illustrated) which is provided in the sub-system 91, the home-position lever (not illustrated) operates.

When the home-position sensor is in an opened state, the home position of motor 131 (except pump 120) is detected. At the time of a power turn, it fluctuates regardless of the position of cap 92 (cap holder 112) (rise and fall), and a move start does not perform position detection.

After detecting the home position of the cap 92, the defined quantity is moved and it moves to the lowest edge. Then, the carriage is moved in the right and left directions, and it is returned to the cap position after position detection, and capping of the recording head 34 is carried out., Next, the cap holding/lifting mechanism for the cap 92 will be explained with reference to FIG. 7 and FIG. 8.

Figure 7:
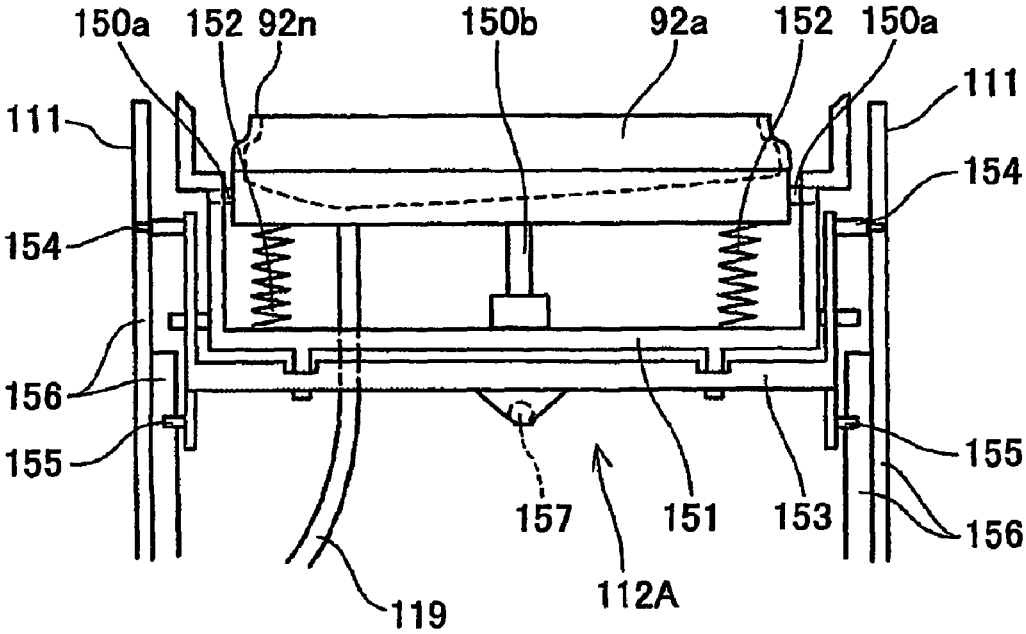
FIG. 7 is a diagram showing the side surface of a cap holding/lifting mechanism.
Figure 8:
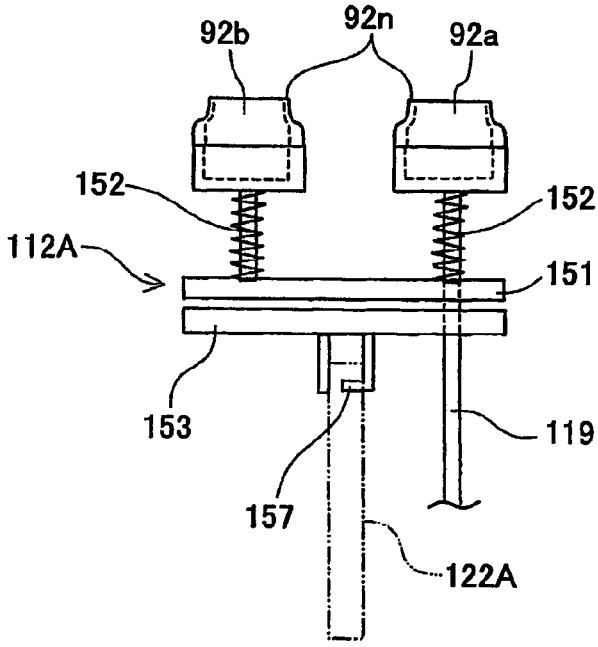
FIG. 8 is a diagram showing the front surface of the cap holding/lifting mechanism.

FIG. 7 shows the side of the cap holding/lifting mechanism. FIG. 8 shows the front of the cap holding/lifting mechanism.

The cap holder 112A forms part of the cap holding mechanism. The cap holder 112A comprises the following: the holder 151; the springs 152; and the slider 153. The holder 151 is provided to hold the cap 92*a* and the cap 92*b* (which are called collectively the cap 92A) so that the cap 92*a* and the cap 92*b* may be moved up and down. The springs 152 are arranged between the bottom of the holder 151 and the bottom of the cap 92A to exert the upward force to the cap 92A. The slider 153 is provided to hold the holder 151 so that the holder is movable in the front-to-rear direction (the direction of arrangement of the nozzles of the recording head 34).

The cap 92A is attached to the holder 151 so that its vertical movement to the holder 151 is possible. The guide pins 150*a* provided at both ends of the cap 92A are inserted to the guide grooves (not illustrated) of the holder 151 so that their vertical movement to the guide grooves is possible. The guide shaft 150*b* provided at the bottom of the cap is inserted to the holder 151 so that its vertical movement is possible.

The springs 152 arranged between the cap 92A and the cap holder 151 are energizing the caps 92*a* and 92*b* upward (in the direction of being pressed to the nozzle surface at the time of capping). The slider 153 is inserted in the guide groove 156 which formed in the frame 111 guide pins 154 and 155 provided in the order edge with its sliding possible, and the slider 153, the holder 151, and the cap 92A can be moved up and down.

The cam pin 157 provided in the undersurface of slider 153 is inserted in the cam groove which cap cam 122A does not illustrate. The slider 153, the holder 151, and the cap 92A are moved up and down by the rotation of the cap cam 122A which is synchronized with the rotation of the cam shaft 121 with which rotation of the motor 131 is transmitted.

The slider 153 and the holder 151 are inserted in the suction cap 92*a*, and to the direction of the shorter side of the cap 92*a*, from the lower part of a cap mid gear, it crawled on tube 119 about and has connected.

The composition in which the cap holder 112B and the holding caps 92*c* and 92*d* (the cap 92B) may be moved up and down is essentially the same as that of the above embodiment, and a description thereof will be omitted.

The tube 119 is not connected to the caps 92*c* and 92*d*. By driving the motor 131 which is one driving source, the cam shaft 121 which is one shaft is rotated.

By rotation of the cam shaft 121, the cams 122A and 122B are fixed to the cam shaft 121 are rotated. Thereby, the cap 92A and the cap 92B are moved up and down.

Figure 9:
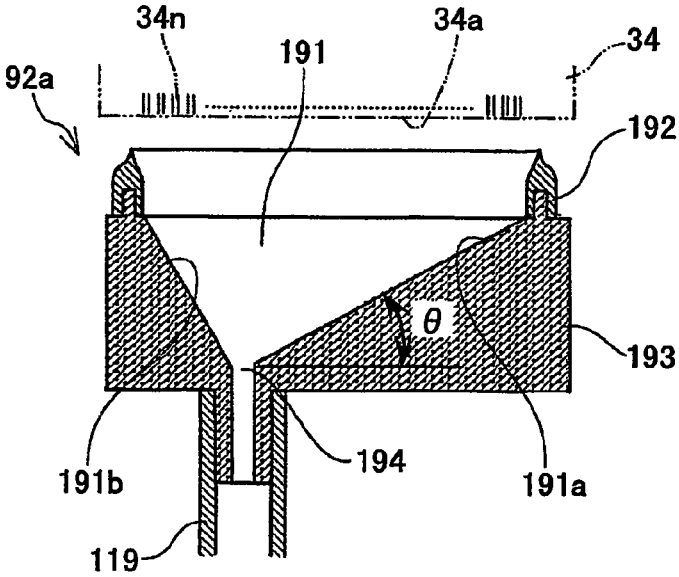
FIG. 9 is a cross-sectional view showing the composition of a cap member.

The suction cap 92*a* includes the contact member 192 which is made of an elastic member and contacts the nozzle side 34*a* in which the nozzle 34*n* which carries out discharge of the droplet of the head 34 is formed, as shown in FIG. 9.

The suction cap 92*a* includes the recess-forming member 193 which holds the contact member 192 and forms the recess 191 which receives the discharging or attracted ink from the nozzle.

The contact member 192 and the recess-forming member 193 are formed by integral molding. After the injection molding of the recess-forming member 193 is carried out using the revolver type injection molding machine, the integral molding of contact member 192 and recess-forming member 193 makes it rotate holding the recess-forming member 193 in a molding die, carries out injection molding and forms the contact member 192 in the recess-forming member 193.

By carrying out the integral molding of the contact member 192 and the recess-forming member 193, the cap pressure gets across to nozzle surface 34*a* enough, and adhesion becomes high. Therefore, the suction of the part can be ensured.

The contact member 192 is made of an elastic material, such as an isobutylene isoprene rubber, a silicone rubber, a fluororubber, EPDM, and a styrene elastomer.

The recess-forming member 193 is made of a resin material containing a water repellent agent, for example, a fluorine water repellent agent, such as HDPE, PP, and PTFE.

The two inclining slopes: the first slope 191*a* and the second slope 191*b* are formed so that the slopes are inclined toward the outlet 194 at the bottom of the recess 191 of the recess-forming member 193 to which the tube 119 is connected.

In this case, the inclination angle θ (theta) of the first slope 191*a* to the horizontal surface is made smaller than the inclination angle of the second slope 191*b* to the horizontal surface.

The formation material of the inclination angle θ (theta) and recess-forming member 193 is selected so that the sum of the contact angle of the component (recess-forming member 193) and ink which form the inclination angle θ (theta) to the horizontal surface of the first slope 191*a* and the first slope 191*a* may become 70 degrees or more.

By forming the recess-forming member 193 of the cap member 92*a* by the resin material containing water repellent agent. Even when the contact member 192 and the recess-forming member 193 are formed by integral molding, water repellence can be given easily to the slopes 191*a* and 191*b* on the recess surface of the recess-forming member 193.

After carrying out integral molding of contact member 192 and the recess-forming member 193 and molding cap member 92*a*, it is difficult to apply water repellent agent to the recess surface including slopes 191*a* and 191*b* of recess-forming member 193 by uniform thickness.

While the manufacturing process becomes complicated, the wear of the water-repellent layer by long-term use arises also for the durability problem. Since this problem is solved, while being able to give water repellence at an easy process by forming recess-forming member 193 by the resin material containing water repellent agent, the durability also improves.

In this case, it is preferred that the content of water repellent agent in the resin material which forms the recess-forming member 193 does not exceed 10 weight %.

According to the molding experiment, when the content of water repellent agent exceeds 10 weight %, the mold-release characteristic from the metal mold becomes too much at the time of molding.

When the recess-forming member 193 is produced with a revolver type molding machine and the metal mold in which the recess-forming member 193 is molded is rotated by the molding machine, the phenomenon that the recess-forming member 193 falls from the metal mold by its gravity will arise. In such a case, the molding efficiency will worsen.

On the other hand, when the content of water repellent agent is 10 weight % or less, the phenomenon of the failing from the metal mold mentioned above does not occur.

As mentioned above, at least two slopes which are inclined toward the outlet are formed in the bottom of the cap member, and the sum of the contact angle between the slopes and the recording liquid and the inclination angle of the slopes of the recess-forming member to the horizontal surface is 70 degrees or more. According to this composition, even when a recording liquid with high viscosity is used in which it contains a water, a pigment, a polymer component and a water-soluble organic solvent; the pigment of 6 weight % or more is contained in the recording liquid; the recording liquid viscosity at 25 degrees C. is more than 5 cp and less than 20 cp; and the surface tension at 25 degrees C. is 40 mN/m or less is used, it is possible to decrease the amount of the discharged recording liquid remaining within the cap member 92*a*.

Namely, if the recording liquid containing a water, a pigment, a polymer component and a water-soluble organic solvent as the essential ingredients is used; the pigment is contained 6% of the weight or more in the ink; the ink viscosity at 25 degrees C. is more than 5 cp and less than 20 cp; and the surface tension of the ink at 25 degrees C. is less than 40 mN/m, then it is possible to form a clear image with high concentration with few blots on a plain paper.

However, when the above-mentioned recording liquid (ink) is used and capping of the nozzle surface is performed with the suction cap as the maintenance/recovery action to perform suction of the recording liquid from the nozzle, the fluidity of the recording liquid to the suction opening (outlet) within the cap member falls, and the amount of the recording liquid (ink) remaining in the cap member increases easily.

If the recording liquid with high viscosity dries during the printing, the viscosity of the recording liquid (ink) increases more remarkably that the case of a dye ink, and it becomes a situation where the ink in the cap member remains easily. The ink remaining in the cap member has an amount of moisture much smaller than that of the original ink.

For this reason, when the capping of the nozzle surface is carried out and the nozzle surface stays over an extended period of time, the moisture is taken from the ink of the nozzle meniscus section, the viscosity of the ink of the nozzle meniscus section increases, and a problem of non-discharging of the recording head easily arises.

To eliminate the problem, the cap member of the above-mentioned embodiment is used. And, it is possible to overcome the problem even when the above-mentioned recording liquid (ink) is used and capping of the nozzle surface is performed.

By forming the recess-forming member 193 with the resin material containing water repellent agent as mentioned above, and giving water repellence to the slopes, the contact angle to the recording liquid becomes large, and the sum of the inclination angle of the recess-forming member slopes and the contact angle between the slopes and the recording liquid becomes large. By this composition, the range of choice of the cap configuration and the kind of recording liquid can be expanded.

Figure 10:
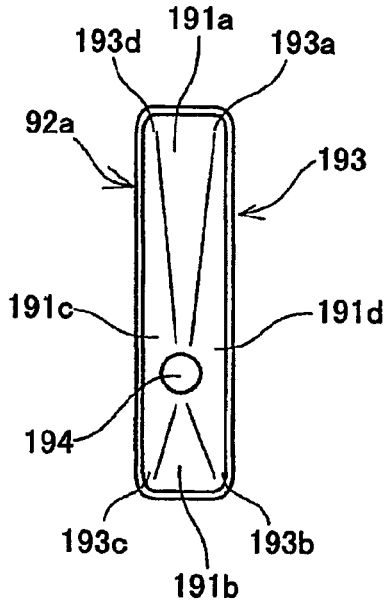
FIG. 10 is a diagram for explaining the composition of the cap member of FIG. 9.

As shown in FIG. 10, the recess-forming member 193 of the cap 92*a* is formed with the slopes 191*a*-191*d* which are inclined continuously from the four sides to the outlet 194. According to this composition, the cross-sectional area of the opening is reduced continuously to the outlet 194, and the recording liquid easily flows toward the outlet 194.

Since the recording liquid is led toward the area (outlet) with a higher negative pressure when drawing in by the negative pressure from the outlet 194 (nozzle suction) the amount of remaining ink can be reduced.

In this case, as shown in FIG. 10, the corner parts of the cap member 92*a*, or the corner parts 193*a*-193*d* of the recess-forming member 193, are formed into curved surfaces.

In the case of use of the high viscosity ink, it is possible to prevent stagnating of the recording liquid at the corner parts. That is, since the ink stagnates easily with the ink surface tension at the corner parts of the recess 191, the staying of the ink can be reduced by forming the corner parts into the curved surface.

The composition of the cap member 92 will be explained. The contact member 192 is made of a styrene elastomer, the recess-forming member 193 is made of a polypropylene, and several cap members 92*a* having different inclination angles θ (theta) are produced.

The polypropylene of the recess-forming member 193 containing a fluorine-based water repellent agent, and the polypropylene of the recess-forming member 193 containing no fluorine-based water repellent agent are produced, respectively.

And the actual ink-jet printing system (Ipsio505 (product name)) to which each of the respective cap members is attached is used. And each of the following ink sets 1, 2, and 3 is used as the ink (recording liquid). After the recovery action which carries out capping of the nozzle surface and attracts the ink by each cap member is performed with the printing operation, the ink remaining state (weight) and the ink jet properties in the cap member are measured.

Next, the ink sets will be described.

<Adjustment of Pigment Dispersion Elements>

(1) Cyan Ink

Adjustment of the phthalocyanine pigment content polymer particulate dispersing element: the example 3 of adjustment of Japanese Laid-Open Patent Application No. 2001-139849 is retested, and the blue polymer particulate dispersing element is obtained. The mean particle size (D50%) of the polymer particulates measured by the micro track UPA is 93 nm.

(2) Magenta Ink

Adjustment of the dimethyl quinacridone pigment content polymer particulate dispersing element: the phthalocyanine pigment of the item (1) above is changed to pigment red 122, and also the polymer particulate dispersing element of the purplish red color is obtained like the above (1). The mean particle size (D50%) of the polymer particulates measured by the micro track UPA is 127 nm.

(3) Yellow Ink

Adjustment of the mono-azo yellow pigment content polymer particulate dispersing element: the phthalocyanine pigment of the item (1) above is changed to pigment yellow 74, and also the yellow polymer particulate dispersing element is obtained like the above (1). The mean particle size (D50%) of the polymer particulates measured by the micro track UPA is 76 nm.

(4) Black Ink

Adjustment of the carbon black pigment content polymer particulate dispersing element: the phthalocyanine pigment of the item (1) above is changed to carbon black (Degussa FW100 (product name)), and also the black polymer particulate dispersing element is obtained like the above (1). The mean particle size (D50%) of the polymer particulates measured by the micro track UPA is 104 nm.

Next, the adjustment of the inks will be explained.

The quantity (%) of each component in the prescription of the following inks is in weight.

<Ink Set 1>

The ink composite of the following prescription is created, and it is adjusted with a 10% lithium-hydroxide solution so that the pH is set to nine. Then, it is filtered with the membrane filter with the average pore size of 0.8 micrometers, and the ink composites of the respective colors: cyan, magenta, yellow and black are obtained.

The surface tension of each ink is in the range of 30-34 mN/m, and the viscosity is in the range of 8-9 cp (25 degrees c).

The prescription is as follows: each prepared color pigment dispersion element 8.0 wt % (solid content); 1,3-butanediol 22.5 wt %; glycerol 7.5 wt %; 2-pyrrolidone 2.0 wt %; R:C12, n=9 in general formula R—(OCH2CH2)nOH (the carbon chain of carbon numbers 6-14 with which R may branch, n:5-20) 2.0 wt %; 2-ethyl 1,3-hexane diol 2.0 wt %; FT-110 (from NEOSU Co.) 0.5 wt %; "Purokiseru LV" (antiseptics) 0.2 wt %; ion exchanged water residual quantity.

<Ink Set 2>

The ink composite of the following prescription is created, and it is adjusted with a 10% lithium-hydroxide solution so that the pH is set to nine. Then, it is filtered with the membrane filter with the average pore size of 0.8 micrometers, and the ink composites of the respective colors: cyan, magenta, yellow and black are obtained.

The surface tension of each ink is in the range of 32-36 mN/m, and the viscosity is in the range 2-3 cp (25 degrees c).

The prescription is as follows: each prepared color pigment dispersion element 4.0 wt % (solid content); diethylene glycol 15.0 wt %; glycerol 5.0 wt %; 2-pyrrolidone 2.0 wt %; "ECTD-3NEX" (anionic surfactant from Nikko Chemicals Co.) 1.0 wt %; 2-ethyl 1,3-hexane diol 2.0 wt %; emulsion 3.0 wt %; "Purokiseru LV" (antiseptics) 0.2 wt %; ion exchanged water residual quantity.

<Ink Set 3>

As the commercially available dye ink, the ink for Ipsio JET300 (from Ricoh Company Ltd.) is used. The surface tension of this ink is in the range of 29-32 mN/m, and the viscosity is in the range of 2.1-2.4 cp.

In this respect, the type of each cap mentioned above, the inclination angle (theta), the contact angle for the ink of each ink set, and the sum of the inclination angle (theta) and the contact angle are shown in Table 1 through Table 3.

TABLE 1

| Suction Cap Type | Inclination Angle (theta) | Water Rep. Agent | Contact Angle (Ink Set 1) | theta plus Contact Angle |
|---|---|---|---|---|
| A | 35 (deg.) | none | 55 (deg.) | 90 (deg.) |
| B | 35 | yes | 60 | 95 |
| C | 30 | none | 55 | 85 |
| D | 30 | yes | 60 | 90 |
| E | 25 | none | 55 | 80 |
| F | 25 | yes | 60 | 85 |
| G | 20 | none | 55 | 75 |
| H | 20 | yes | 60 | 80 |
| I | 15 | none | 55 | 70 |
| J | 15 | yes | 60 | 75 |
| K | 10 | none | 55 | 65 |
| L | 10 | yes | 60 | 70 |
| M | 5 | none | 55 | 60 |
| N | 5 | yes | 60 | 65 |

TABLE 2

| Suction Cap Type | Inclination Angle (theta) | Water Rep. Agent | Contact Angle (Ink Set 2) | theta plus Contact Angle |
|---|---|---|---|---|
| A | 35 (deg.) | none | 56 (deg.) | 91 (deg.) |
| B | 35 | yes | 62 | 97 |
| C | 30 | none | 56 | 86 |
| D | 30 | yes | 62 | 92 |
| E | 25 | none | 56 | 81 |
| F | 25 | yes | 62 | 87 |
| G | 20 | none | 56 | 76 |
| H | 20 | yes | 62 | 82 |
| I | 15 | none | 56 | 71 |
| J | 15 | yes | 62 | 77 |
| K | 10 | none | 56 | 66 |
| L | 10 | yes | 62 | 72 |
| M | 5 | none | 56 | 61 |
| N | 5 | yes | 62 | 67 |

TABLE 3

| Suction Cap Type | Inclination Angle (theta) | Water Rep. Agent | Contact Angle (Ink Set. 3) | theta plus Contact Angle |
|---|---|---|---|---|
| A | 35 (deg.) | none | 72 (deg.) | 107 (deg.) |
| B | 35 | yes | 81 | 116 |
| C | 30 | none | 72 | 102 |
| D | 30 | yes | 81 | 111 |
| E | 25 | none | 72 | 97 |
| F | 25 | yes | 81 | 106 |
| G | 20 | none | 72 | 92 |
| H | 20 | yes | 81 | 101 |
| I | 15 | none | 72 | 87 |
| J | 15 | yes | 81 | 96 |
| K | 10 | none | 72 | 82 |
| L | 10 | yes | 81 | 91 |
| M | 5 | none | 72 | 77 |
| N | 5 | yes | 81 | 86 |

Next, the test results will be explained. The suction cap of the actual system is exchanged with each of the suction caps of the respective types, and the printing of 2000 sheets per day is performed. At this time, the weight of the suction cap is measured for every day, and the ink jet state by the nozzle check pattern is measured for every five days (10,000-sheet printing per day), and the daily changes are measured.

When a non-discharge nozzle by the nozzle check pattern printing is found, the cleaning is carried out once, and the state of the recovery is measured. This procedure is performed using each of the respective ink sets 1, 2, and 3.

The test results when the ink set 1 is used are given in Table 4, the test results when the ink set 2 is used are given in Table 5, and the test results when the ink set 3 is used are given in Table 6, respectively. In the following tables, the "InkQy" (ink quantity) column indicates the weight of the ink adhering to the cap, the "NonDi" (non-discharge nozzle) column indicates as "O" the case where no non-discharge nozzle is found and indicates as "X" the case where a non-discharge nozzle is found, and the "Recov" (recovery) column indicates as "0" the case where the non-discharge nozzle is recovered and indicates as "X" the case where the non-discharge nozzle is not recovered.

TABLE 4

| Cap | < 1 × $10^4$ Print > | | | < 2 × $10^4$ Print > | | | < 5 × $10^4$ Print > | | |
|---|---|---|---|---|---|---|---|---|---|
| Type | InkQy | NonDi | Recov | InkQy | NonDi | Recov | InkQy | NonDi | Recov |
| A | 0.02 g | ○ | — | 0.02 g | ○ | — | 0.02 g | ○ | — |
| B | 0.02 g | ○ | — | 0.02 g | ○ | — | 0.02 g | ○ | — |
| C | 0.02 g | ○ | — | 0.02 g | ○ | — | 0.03 g | ○ | — |
| D | 0.02 g | ○ | — | 0.02 g | ○ | — | 0.02 g | ○ | — |
| E | 0.03 g | ○ | — | 0.04 g | ○ | — | 0.06 g | ○ | — |
| F | 0.02 g | ○ | — | 0.02 g | ○ | — | 0.03 g | ○ | — |
| G | 0.04 g | ○ | — | 0.05 g | ○ | — | 0.09 g | X | ○ |
| H | 0.02 g | ○ | — | 0.03 g | ○ | — | 0.04 g | ○ | — |
| I | 0.04 g | ○ | — | 0.05 g | ○ | — | 0.12 g | X | ○ |
| J | 0.04 g | ○ | — | 0.05 g | ○ | — | 0.08 g | X | ○ |
| K | 0.05 g | ○ | ○ | 0.08 g | X | ○ | 0.35 g | X | X |
| L | 0.04 g | ○ | — | 0.05 g | ○ | — | 0.07 g | X | ○ |
| M | 0.17 g | ○ | ○ | 0.20 g | X | X | 0.63 g | X | X |
| N | 0.04 g | ○ | — | 0.08 g | X | ○ | 0.13 g | X | X |

TABLE 5

| Cap | < 1 × $10^4$ Print > | | | < 2 × $10^4$ Print > | | | < 5 × $10^4$ Print > | | |
|---|---|---|---|---|---|---|---|---|---|
| Type | InkQy | NonDi | Recov | InkQy | NonDi | Recov | InkQy | NonDi | Recov |
| A | 0.01 g | ○ | — | 0.01 g | ○ | — | 0.01 g | ○ | — |
| B | 0.01 g | ○ | — | 0.01 g | ○ | — | 0.01 g | ○ | — |
| C | 0.01 g | ○ | — | 0.02 g | ○ | — | 0.02 g | ○ | — |
| D | 0.01 g | ○ | — | 0.01 g | ○ | — | 0.01 g | ○ | — |
| E | 0.02 g | ○ | — | 0.03 g | ○ | — | 0.04 g | ○ | — |
| F | 0.01 g | ○ | — | 0.02 g | ○ | — | 0.02 g | ○ | — |
| G | 0.02 g | ○ | — | 0.03 g | ○ | — | 0.05 g | ○ | — |
| H | 0.01 g | ○ | — | 0.02 g | ○ | — | 0.02 g | ○ | — |
| I | 0.03 g | ○ | — | 0.03 g | ○ | — | 0.05 g | X | ○ |
| J | 0.02 g | ○ | — | 0.02 g | ○ | — | 0.02 g | X | ○ |
| K | 0.02 g | ○ | — | 0.02 g | ○ | — | 0.02 g | X | X |
| L | 0.02 g | ○ | — | 0.02 g | ○ | — | 0.03 g | X | ○ |
| M | 0.04 g | ○ | — | 0.08 g | X | X | 0.13 g | X | X |
| N | 0.03 g | ○ | — | 0.03 g | ○ | — | 0.04 g | X | ○ |

TABLE 6

| Cap | < 1 × $10^4$ Print > | | | < 2 × $10^4$ Print > | | | < 5 × $10^4$ Print > | | |
|---|---|---|---|---|---|---|---|---|---|
| Type | InkQy | NonDi | Recov | InkQy | NonDi | Recov | InkQy | NonDi | Recov |
| A | 0.01 g | ○ | — | 0.01 g | ○ | — | 0.01 g | ○ | — |
| B | 0.01 g | ○ | — | 0.01 g | ○ | — | 0.01 g | ○ | — |
| C | 0.01 g | ○ | — | 0.01 g | ○ | — | 0.01 g | ○ | — |
| D | 0.01 g | ○ | — | 0.01 g | ○ | — | 0.01 g | ○ | — |
| E | 0.01 g | ○ | — | 0.01 g | ○ | — | 0.01 g | ○ | — |
| F | 0.01 g | ○ | — | 0.01 g | ○ | — | 0.01 g | ○ | — |
| G | 0.01 g | ○ | — | 0.01 g | ○ | — | 0.01 g | X | — |
| H | 0.01 g | ○ | — | 0.01 g | ○ | — | 0.01 g | ○ | — |
| I | 0.01 g | ○ | — | 0.01 g | ○ | — | 0.01 g | ○ | — |
| J | 0.01 g | ○ | — | 0.01 g | ○ | — | 0.01 g | ○ | — |
| K | 0.01 g | ○ | — | 0.01 g | ○ | — | 0.01 g | ○ | — |
| L | 0.01 g | ○ | — | 0.01 g | ○ | — | 0.01 g | ○ | — |
| M | 0.02 g | ○ | — | 0.02 g | ○ | — | 0.02 g | ○ | — |
| N | 0.02 g | ○ | — | 0.02 g | ○ | — | 0.02 g | ○ | — |

From the above Tables 4 through 6, it is found out that if "the sum of the inclination angle theta and the contact angle" is above 70 degrees, even when a non-discharge nozzle arises after 50,000-sheet printing, the nozzle is recovered by the cleaning (or the recovery action).

In the case of the above Table 5, the ink set 2 is used and a non-discharge nozzle arises after 50,000-sheet printing for the cap type N, and the result shows that that nozzle is recovered by the cleaning (or the recovery action). It is preferred that the sum of the inclination angle and the contact angle is 70 degrees or more, because of the ink components thereof.

It is confirmed that, if the sum of the inclination angle and the contact angle is above 75 degrees, any non-discharge nozzle does not arise (see the difference between the cap type G of Table 4 and the cap type G of Table 5). In particular, is found out that, if the sum of the inclination angle and the contact angle is above 90 degrees, the attracted ink falls to the slopes of the recess and are easily led to the outlet. In this case, there is almost no remaining ink on the cap member, and the non-discharge nozzle does not arise in the printing over an extended period of time.

In this case, the water-repellent finish is created on the recess inside the cap member, so that the range of the contact angle of the cap member to the ink is increased. And the sum of the inclination angle and the contact angle is also increased. Therefore, it is possible to increase the range of selection of the cap shape and the ink kind.

The maintenance/recovery device of the present invention is applicable to image forming devices other than an ink jet printer, such as a facsimile device, a copier device, a multi-function peripheral, etc. Moreover, the maintenance/recovery device of the present invention is applicable also to a maintenance/recovery device for a liquid discharge device which discharges a droplet of a liquid different from the ink (the recording liquid), for example, a resist, a DNA sample in the medical field, etc.

The present invention is not limited to the above-described embodiments and variations and modifications may be made without departing from the scope of the invention.

The invention claimed is:

1. A maintenance/recovery device for a liquid discharge device, comprising:

a cap member covering a surface of a nozzle of a liquid discharging head, the liquid discharging head discharging a droplet of a recording liquid from the nozzle;

a resilient contact member provided in the cap member to come in contact with the surface of the nozzle;

a recess-forming member provided in the cap member to form a recess for receiving the recording liquid attracted from the nozzle, wherein the contact member and the recess-forming member are integrally formed by molding, the recess-forming member is made of a water-repellant resin material containing a water repellent agent, and the recess-forming member comprises a plurality of slopes providing respective inclined surfaces extending to an outlet at a bottom of the recess from an entire circumference of an opening part of the cap member, each of the inclined surfaces forming an inclination angle equal to or larger than 20 degrees with respect to a horizontal plane.

2. The maintenance/recovery device according to claim 1 wherein a content of the water repellent agent in the resin material which forms the recess-forming member does not exceed 10 weight percent.

3. The maintenance/recovery device according to claim 1 wherein the recess of the recess-forming member is provided with corners which are curved.

4. The maintenance/recovery device according to claim 1 wherein a sum of the inclination angle of the slopes of the recess-forming member with respect to the horizontal plane and a contact angle between the slopes and the recording liquid is 70 degrees or more.

5. The maintenance/recovery device according to claim 4 wherein the sum of the inclination angle and the contact angle is 90 degrees or more.

6. An image forming device comprising:

a liquid discharge head provided as a recording head which discharges a droplet of a recording liquid from a nozzle; and a maintenance/recovery device provided to maintain and recover performance of the liquid discharge head, the maintenance/recovery device comprising:

a cap member covering a surface of the nozzle of the liquid discharging head;

a resilient contact member provided in the cap member to come in contact with the surface of the nozzle;

a recess-forming member provided in the cap member to form a recess for receiving the recording liquid attracted from the nozzle, wherein the contact member and the recess-forming member are integrally formed by molding, the recess-forming member is made of a water-repellant resin material containing a water repellent agent, and the recess-forming member comprises a plurality of slopes providing respective inclined surfaces extending to an outlet at a bottom of the recess from an entire circumference of an opening part of the cap member, each of the inclined surfaces forming an inclination angle equal to or larger than 20 degrees with respect to a horizontal plane.

7. The image forming device according to claim 6 wherein the recording liquid contains a water, a pigment of 6 weight percent or more, a polymer component, and a water-soluble organic solvent, and the recording liquid has a surface tension of 40 mN/m or less at 25 degrees C and has a viscosity that is above 5 cp and below 20 cp at 25 degrees C.

8. The image forming device according to claim 6 wherein a content of the water repellent agent in the resin material which forms the recess-forming member does not exceed 10 weight percent.

9. The image forming device according to claim 6 wherein the recess of the recess-forming member is provided with corners which are curved.

10. The image forming device according to claim 6 wherein a sum of the inclination angle of the slopes of the recess-forming member with respect to the horizontal plane and a contact angle between the slopes and the recording liquid is 70 degrees or more.

* * * * *